US012564278B1

(12) United States Patent
Quiroz et al.

(10) Patent No.: US 12,564,278 B1
(45) Date of Patent: Mar. 3, 2026

(54) HEADREST PILLOW DEVICE

(71) Applicants: Isaac Quiroz, Fresno, CA (US); Sukhwinder Kaur, Fresno, CA (US)

(72) Inventors: Isaac Quiroz, Fresno, CA (US); Sukhwinder Kaur, Fresno, CA (US)

( * ) Notice: Subject to any disclaimer, the term of this patent is extended or adjusted under 35 U.S.C. 154(b) by 0 days.

(21) Appl. No.: 18/825,721

(22) Filed: Sep. 5, 2024

(51) Int. Cl.
*A47C 16/00* (2006.01)
*A47G 9/10* (2006.01)

(52) U.S. Cl.
CPC ..... *A47G 9/1045* (2013.01)

(58) Field of Classification Search
CPC .. A47C 16/00; A47C 7/36; A47C 7/38; A47C 7/383; A47G 9/1072
See application file for complete search history.

(56) References Cited

U.S. PATENT DOCUMENTS

| | | | | |
|---|---|---|---|---|
| 4,617,691 | A * | 10/1986 | Monti | A47C 7/383 5/636 |
| 6,289,538 | B1 | 9/2001 | Fidge | |
| 6,973,691 | B1 * | 12/2005 | Cordova | A47C 7/383 5/652 |
| 7,055,197 | B1 | 6/2006 | Fathali | |
| 8,333,308 | B2 * | 12/2012 | Maginness | A47C 7/383 224/153 |
| 9,226,605 | B1 | 1/2016 | Castellano | |
| 9,943,179 | B1 * | 4/2018 | May | A47C 7/383 |
| 9,968,198 | B2 | 5/2018 | Hauer | |
| 11,297,961 | B2 | 4/2022 | Lowry | |
| D978,571 | S | 2/2023 | Crist | |
| 2002/0084685 | A1 * | 7/2002 | Lee | B60N 2/882 297/397 |
| 2019/0133350 | A1 | 5/2019 | Greene, Jr. | |
| 2020/0022510 | A1 * | 1/2020 | Shokrian | A47G 9/0253 |
| 2024/0197075 | A1 * | 6/2024 | Yang | A47C 16/00 |

FOREIGN PATENT DOCUMENTS

| | | | | |
|---|---|---|---|---|
| CN | 104757808 | A * | 7/2015 | A47C 16/00 |
| CN | 105534202 | A * | 5/2016 | A47G 9/10 |
| CN | 205667490 | U * | 11/2016 | A47C 7/383 |
| CN | 206699924 | U * | 12/2017 | A47C 16/00 |
| KR | 101672972 | B1 * | 11/2016 | A47C 7/383 |
| WO | WO2014121258 | | 8/2014 | |
| WO | WO-2020005050 | A1 * | 1/2020 | A47D 13/025 |

* cited by examiner

*Primary Examiner* — David E Sosnowski
*Assistant Examiner* — Ifeolu A Adeboyejo

(57) ABSTRACT

A headrest pillow device includes a first cushion which has a concavely contoured first lateral surface to define a first headrest which conforms to the shape of a first user's head when the first user rests their head against the first headrest. An arm grip is attached to the first cushion to secure the first cushion to a second user's arm. The arm grip is positioned on an opposing side of the first cushion from the headrest to enable the first user to lean against the second user's arm. A second cushion extends upwardly from the first cushion and the second cushion has a concavely contoured upper surface to define a second headrest which conforms to the shape of the second user's head when the second user rests their head against the second headrest. In this way the first user and the second user can sleep in an upright position.

6 Claims, 4 Drawing Sheets

HEADREST PILLOW DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to headrest devices and more particularly pertains to a new headrest device for enabling a first user to lean against a second user when each of the first user and the second user wish to sleep in an upright position. The device includes a first cushion that has a concavely arcuate first headrest to accommodate the shape of the first user's head. The device includes an arm grip which is attached to the first cushion when can be releasably attached to a second user's arm to secure the first cushion to the second user's arm. The device includes a second cushion that is attached to the first cushion and the second cushion has a concavely arcuate second headrest to accommodate the shape of the second user's head. In this way the first user and the second user can lean against each other to sleep in an upright position.

(2) Description of Related Art Including Information Disclosed Under 37 CFR 1.97 and 1.98

The prior art relates to headrest devices including a variety of headrest devices that each at least includes a pillow which is strategically structured to accommodate a neck and a head of a user to enable the user to sleep in an ergonomically preferred orientation. In no instance does the prior art disclose a headrest device that includes a first cushion that has a first headrest to accommodate a first users head and an arm grip attached to the first cushion to secure the first cushion to a second user's arm and a second cushion attached to the first cushion which has a second headrest to accommodate the second user's head thereby enabling the first user and the second user to sleep in an upright position.

(h) BRIEF SUMMARY OF THE INVENTION

An embodiment of the disclosure meets the needs presented above by generally comprising a first cushion which has a concavely contoured first lateral surface to define a first headrest which conforms to the shape of a first user's head when the first user rests their head against the first headrest. An arm grip is attached to the first cushion to secure the first cushion to a second user's arm. The arm grip is positioned on an opposing side of the first cushion from the headrest to enable the first user to lean against the second user's arm. A second cushion extends upwardly from the first cushion and the second cushion has a concavely contoured upper surface to define a second headrest which conforms to the shape of the second user's head when the second user rests their head against the second headrest. In this way the first user and the second user can sleep in an upright position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
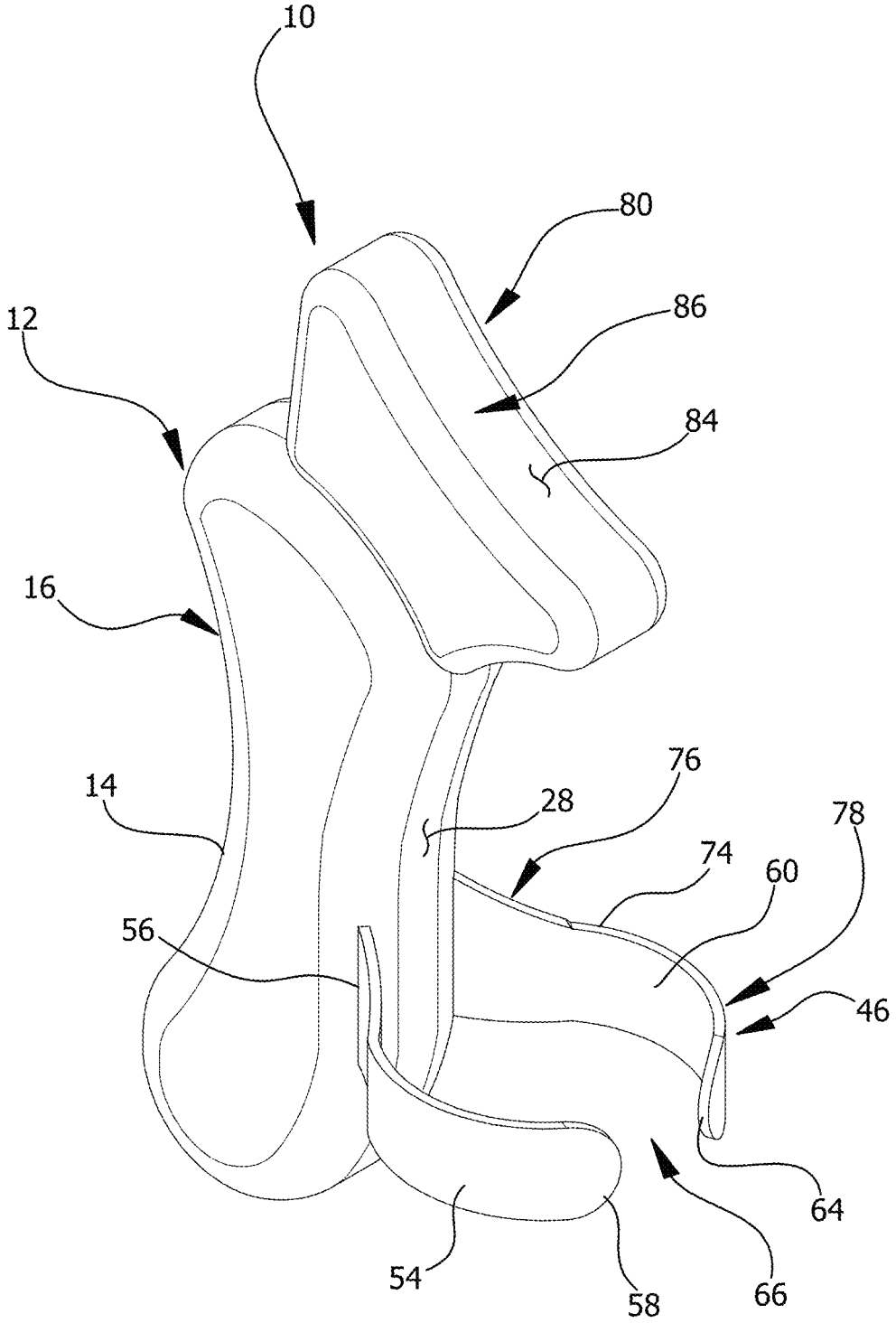
FIG. 1 is a front perspective view of a headrest pillow device according to an embodiment of the disclosure.
Figure 2:
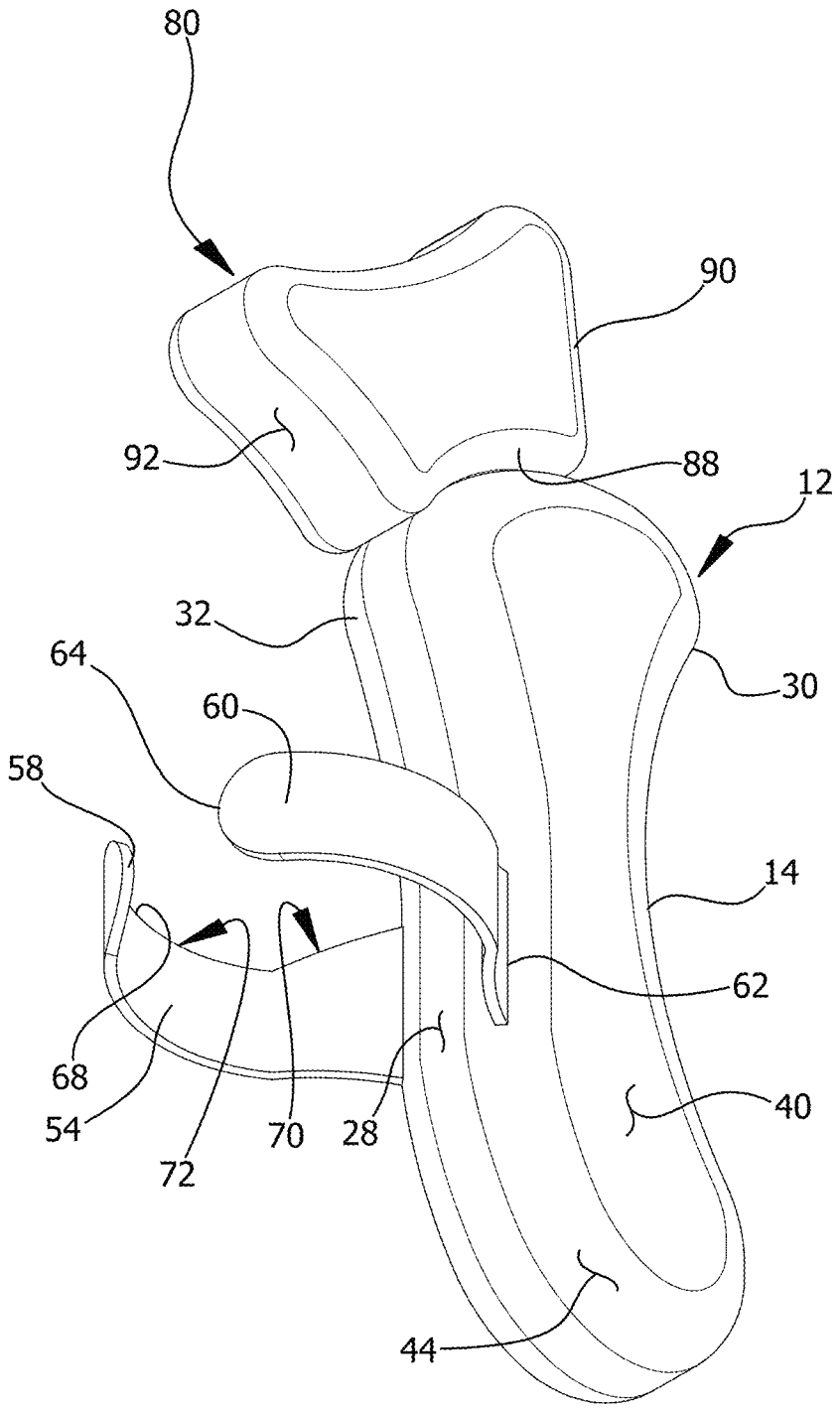
FIG. 2 is a bottom perspective view of an embodiment of the disclosure.
Figure 3:
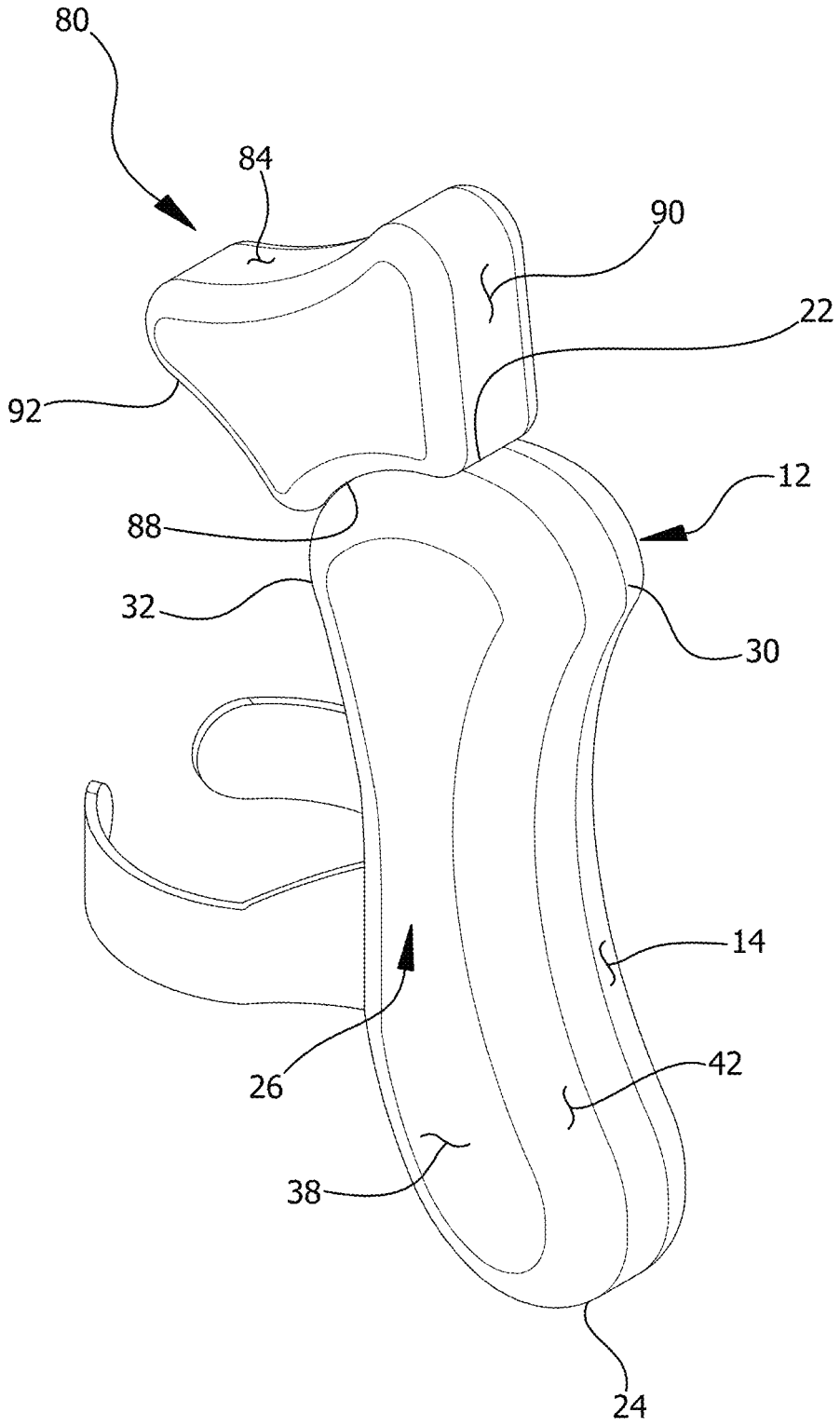
FIG. 3 is a back perspective view of an embodiment of the disclosure.
Figure 4:
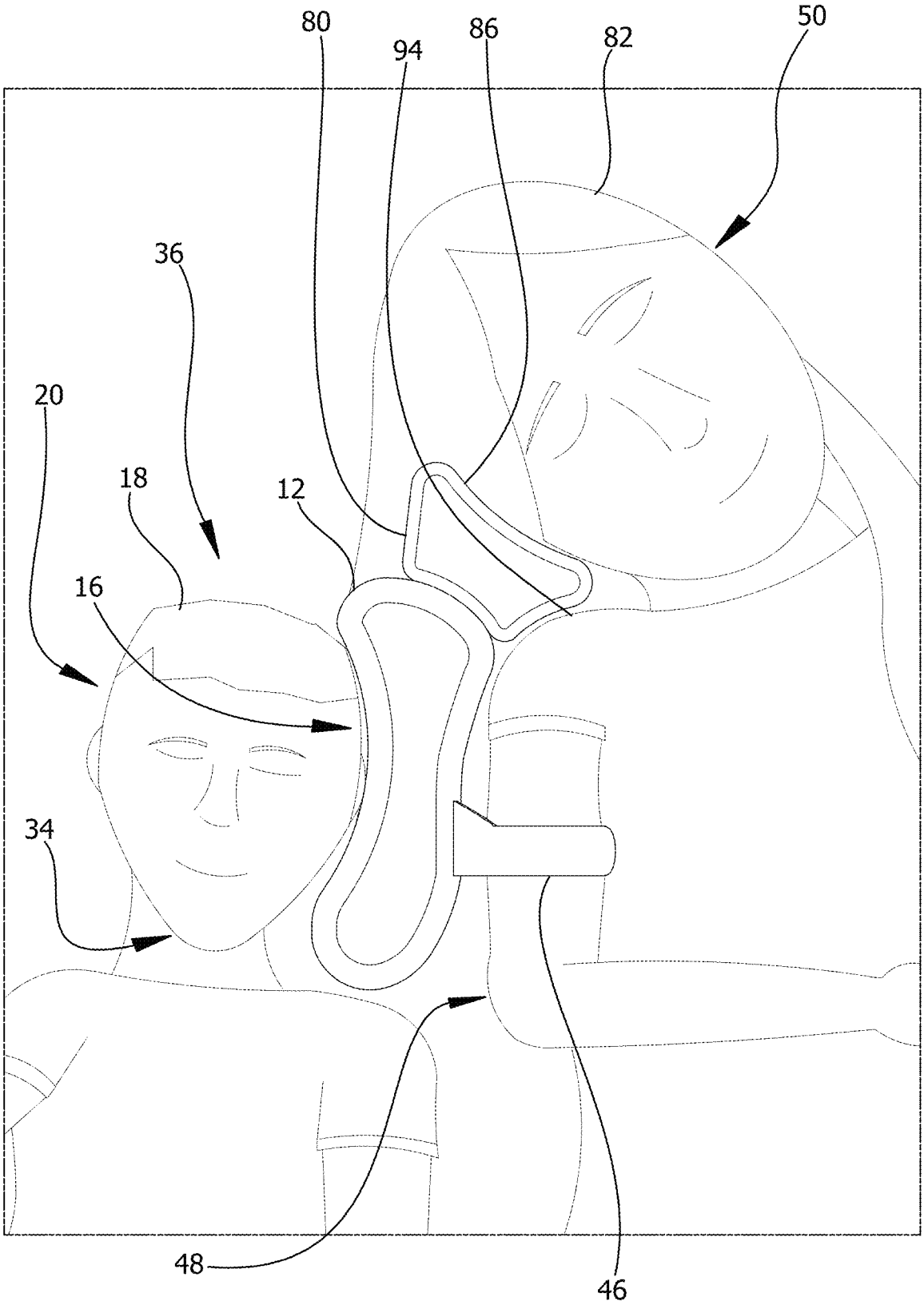
FIG. 4 is a perspective in-use view of an embodiment of the disclosure.

With reference now to the drawings, and in particular to FIGS. 1 through 4 thereof, a new headrest device embodying the principles and concepts of an embodiment of the disclosure and generally designated by the reference numeral 10 will be described.

As best illustrated in FIGS. 1 through 4, the headrest pillow device 10 generally comprises a first cushion 12 which has a first lateral surface 14 that is concavely contoured to define a first headrest 16. In this way the first headrest 16 can conform to the shape of a head 18 of a first user 20 when the first user 20 rests their head 18 against the first headrest 16. The first cushion 12 has a top end 22 and a bottom end 24 having the first lateral surface 14 extending between the top end 22 and the bottom end 24. Furthermore, the first lateral surface 14 curves toward a center 26 of the first cushion 12 between the top end 22 and the bottom end 24 and each of the top end 22 and the bottom end 24 is rounded. The first cushion 12 is comprised of a resiliently compressible material, including but not being limited to rubber or silicone, thereby enhancing comfort for the first user 20.

The first cushion 12 has a second lateral surface 28 extending between the top end 22 and the bottom end 24; the top end 22 has a first intersection 30 between the first lateral surface 14 and a second intersection 32 between the second lateral surface 28. The first intersection 30 tapers to a blunt point which extends laterally away from the center 26 of the first cushion 12. The second intersection 32 is rounded and the first intersection 30 is spaced further from the bottom end 24 than the second intersection 32 is spaced from the bottom end 24. Additionally, the first cushion 12 is curved toward the first lateral surface 14 along an axis extending between the top end 22 and the bottom end 24 such that an intersection between the bottom end 24 and the first lateral surface 14 extends beneath the first user's jaw 34 when the first user 20 leans their head 18 against the first lateral surface 14. Furthermore, the first intersection 30 extends toward a crown 36 of the first user's head 18 when the first user 20 leans their head 18 against the first lateral surface 14.

The first cushion 12 has a front surface 38 and a back surface 40 and the first cushion 12 has a front curved surface 42 which extends around a full perimeter of the front surface 38. Additionally, the front curved surface 42 intersects the first lateral surface 14 and the second lateral surface 28 and the top end 22 and the bottom end 24; the front curved surface 42 curves toward the back surface 40. The first cushion 12 has a back curved surface 44 which extends around a full perimeter of the back surface 40 such that the back curved surface 44 intersects the first lateral surface 14 and the second lateral surface 28 and the top end 22 and the bottom end 24; the back curved surface 44 curves toward the front surface 38.

An arm grip 46 is attached to and extends laterally away from the first cushion 12 such that the arm grip 46 extends partially around an arm 48 of a second user 50 for securing the first cushion 12 to the second user's arm 48. The arm grip 46 is positioned on an opposing side of the first cushion 12 from the headrest to enable the first user 20 to lean against the second user's arm 48 when the first user 20 leans their head 18 against the first headrest 16. The arm grip 46 comprises a first member 54 which has a coupled end 56 that is coupled to the front curved surface 42 of the first cushion 12 at a point which is located closer to the bottom end 24 than the top end 22. The first member 54 has a distal end 58 which is spaced from the second lateral surface 28 such that the first member 54 extends along an axis that is perpendicular to the axis extending between the top end 22 and the bottom end 24 of the first cushion 12. The first member 54 curves outwardly between the coupled end 56 and the distal end 58 to conform to curvature of the second user's arm 48.

The arm grip 46 comprises a second member 60 has a coupled end 62 which is coupled to the back curved surface 44 of the first cushion 12 at a point that is located closer to the bottom end 24 than the top end 22 such that the second member 60 is aligned with the first member 54. The second member 60 has a distal end 64 that is spaced from the second lateral surface 28 such that the second member 60 extends along an axis which is perpendicular to the axis extending between the top end 22 and the bottom end 24 of the first cushion 12. The second member 60 curves outwardly between the coupled end 62 of the second member 60 and the distal end 64 of the second member 60 to conform to curvature of the second user's arm 48. The distal end 58 of the first member 54 is spaced from and is directed toward the distal end 64 of the second member 60 to define an arm space 66 between the distal end 58 of the first member 54 and the distal end 64 of the second member 60. Furthermore, the arm space 66 enables the second user's arm 48 to pass through the arm space 66 for releasably attaching the arm grip 46 to the second user's arm 48. The first member 54 has a top edge 68 and the top edge 68 has a rear section 70 that angles upwardly between a forward section 72 of the top edge 68 and the front curved surface 42 of the first cushion 12. The second member 60 has a top edge 74 and the top edge 74 of the second member 60 has a back section 76 which angles upwardly between a front section 78 of the top edge 74 of the second member 60 and the back curved surface 44 of the first cushion 12.

A second cushion 80 is provided and the second cushion 80 is attached to the first cushion 12. The second cushion 80 extends upwardly from the first cushion 12 such that the second cushion 80 is directed toward a head 82 of the second user 50 when the arm grip 46 is attached to the second user's arm 48. Furthermore, the second cushion 80 has an upper surface 84 which is concavely contoured to define a second headrest 86. The second headrest 86 conforms to the shape of the second user's head 82 when the second user 50 leans their head 82 against the second headrest 86 thereby enabling first user 20 and the second user 50 to comfortably sleep in an orientation having the first user 20 leaning against the second user 50. Additionally, the second cushion 80 is comprised of a resiliently compressible material, including but not being limited to rubber or silicone, thereby enhancing comfort for the second user 50.

The second cushion 80 has a lower surface 88 which is bonded to the top end 22 of the first cushion 12 such that the lower surface 88 extends from the second intersection 32 of the top end 22 of the first cushion 12 toward the first intersection 30 of the top end 22 of the first cushion 12. Additionally, the second cushion 80 has a primary lateral surface 90 and a secondary lateral surface 92. The upper surface 84 is concavely arcuate between the primary lateral surface 90 and the secondary lateral surface 92. The lower surface 88 is concavely arcuate between the primary lateral surface 90 and the secondary lateral surface 92 thereby enabling the lower surface 88 to conform to curvature of the top end 22 of the first cushion 12. Additionally, the secondary lateral surface 92 is concavely arcuate between the lower surface 88 and the upper surface 84 to accommodate the second user's shoulder 94 when the second user's arm 48 is positioned in the arm grip 46. Furthermore, the upper surface 84 has a length which is greater than a length of the lower surface 88 such that the second cushion 80 has a trapezoidal shape.

In use, the second user 50 places their upper arm 48 into the arm grip 46 to secure the first cushion 12 and the second cushion 80 to the user's upper arm 48. The first user 20 leans their head 18 against the first lateral surface 14 of the first cushion 12 and the second user 50 leans their head 82 against the upper surface 84 of the second cushion 80. In this way the first user 20 and the second user 50 can sleep in a seated position having the first user 20 leaning against the second user 50. Thus, the first user 20 and second user 50 can sleep while the first user 20 and the second user 50 are traveling on a commercial aircraft, for example, or other situation that involves the first user 20 and the second user 50 being in a seated position for an extended period of time. Furthermore, the weight of the first user 20 and the second user 50 enables the first cushion 12 and the second cushion 80 to remain in place while the first user 20 and the second user 50 are sleeping.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A headrest pillow device for enabling a first user to comfortably rest against the shoulder of a second user while the first user and the second user are sleeping, said device comprising:

a first cushion having a first lateral surface being concavely contoured to define a first headrest wherein said first headrest is configured to conform to the shape of a first user's head when the first user rests their head against said first headrest;

an arm grip being attached to and extending laterally away from said first cushion wherein said arm grip is configured to extend partially around a second user's arm for securing said first cushion to the second user's arm, said arm grip being positioned on an opposing side of said first cushion from said headrest wherein said arm grip is configured to enable the first user to lean against the second user's arm when the first user leans their head against said first headrest; and a second cushion being attached to said first cushion, said second cushion extending upwardly from said first cushion wherein said second cushion is configured to be directed toward the second user's head when said arm grip is attached to the second user's arm, said second cushion having an upper surface being concavely contoured to define a second headrest wherein said second headrest is configured to conform to the shape of the second user's head when the second user rests their head against said second headrest thereby enabling the first user and the second user to comfortably sleep in an orientation having the first user leaning against the second user;

wherein said first cushion has a top end and a bottom end having said first lateral surface extending between said top end and said bottom end; said first lateral surface curves toward a center of said first cushion between said top end and said bottom end; each of said top end and said bottom end is rounded;

said first cushion has a second lateral surface extending between said top end and said bottom end; said top end has a first intersection between said top end and said first lateral surface; and a second intersection between said top end and said second lateral surface; said first intersection tapers to a blunt point which extends laterally away from said center of said first cushion; said second intersection is rounded; said first intersection is spaced further from said bottom end than said second intersection is spaced from said bottom end;

and said first cushion is curved toward said first lateral surface along an axis extending between said top end and said bottom end wherein an intersection between said bottom end and said first lateral surface is configured to extend beneath the first user's jaw when the first user leans their head against said first lateral surface having said first intersection extending toward a crown of the first user's head when the first user leans their head against said first lateral surface.

2. The headrest pillow device according to claim 1, wherein:

said first cushion has a front surface and a back surface;

said first cushion has a front curved surface which extends around a full perimeter of said front surface such that said front curved surface intersects said first lateral surface and said second lateral surface and said top end and said bottom end;

said front curved surface curves toward said back surface;

said first cushion has a back curved surface which extends around a full perimeter of said back surface such that said back curved surface intersects said first lateral surface and said second lateral surface and said top end and said bottom end; and said back curved surface curves toward said front surface.

3. The headrest pillow device according to claim 2, wherein:

said arm grip comprises a first member having a coupled end being coupled to said front curved surface of said first cushion at a point being located closer to said bottom end than said top end; and said arm grip comprises a second member having a coupled end being coupled to said back curved surface of said first cushion at a point being located closer to said bottom end than said top end such that said second member is aligned with said first member.

4. The headrest pillow device according to claim 3, wherein:

said first member has a distal end being spaced from said second lateral surface of said first cushion such that said first member extends along an axis being perpendicular to said axis extending between said top end and said bottom end of said first cushion;

said first member curves outwardly between said coupled end and said distal end wherein said first member is configured to conform to curvature of the second user's arm;

said second member has a distal end being spaced from said second lateral surface of said first cushion such that said second member extends along an axis being perpendicular to said axis extending between said top end and said bottom end of said first cushion;

said second member curves outwardly between said coupled end of said second member and said distal end of said second member wherein said second member is configured to conform to curvature of the second user's arm;

said distal end of said first member is spaced from and is directed toward said distal end of said second member to define an arm space between said distal end of said first member and said distal end of said second member wherein said arm space is configured to enable the second user's arm to pass through said arm space for releasably attaching said arm grip to the second user's arm.

5. The headrest pillow device according to claim 1, wherein:

said second cushion has a lower surface being bonded to said top end of said first cushion such that said lower surface extends from said second intersection of said top end of said first cushion toward said first intersection of said top end of said first cushion;

said second cushion has an upper surface and a primary lateral surface and a secondary lateral surface;

said upper surface is concavely arcuate between said primary lateral surface and said secondary lateral surface;

said lower surface is concavely arcuate between said primary lateral surface and said secondary lateral surface thereby enabling said lower surface to conform to curvature of said top end of said first cushion;

said secondary lateral surface is concavely arcuate between said lower end and said upper end wherein said secondary lateral surface is configured to accommodate the second user's shoulder when the second user's arm is positioned in said arm grip; and said upper surface has a length being greater than a length of said lower surface such that said second cushion has a trapezoidal shape.

6. A headrest pillow device for enabling a first user to comfortably rest against the shoulder of a second user while the first user and the second user are sleeping, said device comprising:

a first cushion having a first lateral surface being concavely contoured to define a first headrest wherein said first headrest is configured to conform to the shape of a first user's head when the first user rests their head against said first headrest, said first cushion having a top end and a bottom end having said first lateral surface extending between said top end and said bottom end, said first lateral surface curving toward a center of said first cushion between said top end and said bottom end, each of said top end and said bottom end being rounded, said first cushion having a second lateral surface extending between said top end and said bottom end, said top end having a first intersection between said top end and said first lateral surface and a second intersection between said top end and said second lateral surface, said first intersection tapering to a blunt point which extends laterally away from said center of said first cushion, said second intersection being rounded, said first intersection being spaced further from said bottom end than said second intersection is spaced from said bottom end, said first cushion being curved toward said first lateral surface along an axis extending between said top end and said bottom end wherein an intersection between said bottom end and said first lateral surface is configured to extend beneath the first user's jaw when the first user leans their head against said first lateral surface having said first intersection extending toward a crown of the first user's head when the first user leans their head against said first lateral surface, said first cushion having a front surface and a back surface, said first cushion having a front curved surface which extends around a full perimeter of said front surface such that said front curved surface intersects said first lateral surface and said second lateral surface and said top end and said bottom end, said front curved surface curving toward said back surface, said first cushion having a back curved surface which extends around a full perimeter of said back surface such that said back curved surface intersects said first lateral surface and said second lateral surface and said top end and said bottom end, said back curved surface curving toward said front surface;

an arm grip being attached to and extending laterally away from said first cushion wherein said arm grip is configured to extend partially around a second user's arm for securing said first cushion to the second user's arm, said arm grip being positioned on an opposing side of said first cushion from said headrest wherein said arm grip is configured to enable the first user to lean against the second user's arm when the first user leans their head against said first headrest, said arm grip comprising a first member having a coupled end being coupled to said front curved surface of said first cushion at a point being located closer to said bottom end than said top end, said first member having a distal end being spaced from said second lateral surface such that said first member extends along an axis being perpendicular to said axis extending between said top end and said bottom end of said first cushion, said first member curving outwardly between said coupled end and said distal end wherein said first member is configured to conform to curvature of the second user's arm, said arm grip comprising a second member having a coupled end being coupled to said back curved surface of said first cushion at a point being located closer to said bottom end than said top end such that said second member is aligned with said first member, said second member having a distal end being spaced from said second lateral surface such that said second member extends along an axis being perpendicular to said axis extending between said top end and said bottom end of said first cushion, said second member curving outwardly between said coupled end of said second member and said distal end of said second member wherein said second member is configured to conform to curvature of the second user's arm, said distal end of said first member being spaced from and being directed toward said distal end of said second member to define an arm space between said distal end of said first member and said distal end of said second member wherein said arm space is configured to enable the second user's arm to pass through said arm space for releasably attaching said arm grip to the second user's arm; and a second cushion being attached to said first cushion, said second cushion extending upwardly from said first cushion wherein said second cushion is configured to be directed toward the second user's head when said arm grip is attached to the second user's arm, said second cushion having an upper surface being concavely contoured to define a second headrest wherein said second headrest is configured to conform to the shape of the second user's head when the second user rests their head against said second headrest thereby enabling the first user and the second user to comfortably sleep in an orientation having the first user leaning against the second user, said second cushion having a lower surface being bonded to said top end of said first cushion such that said lower surface extends from said second intersection of said top end of said first cushion toward said first intersection of said top end of said first cushion, said second cushion having a primary lateral surface and a secondary lateral surface, said upper surface being concavely arcuate between said primary lateral surface and said secondary lateral surface, said lower surface being concavely arcuate between said primary lateral surface and said secondary lateral surface thereby enabling said lower surface to conform to curvature of said top end of said first cushion, said secondary lateral surface being concavely arcuate between said lower end and said upper end wherein said secondary lateral surface is configured to accommodate the second user's shoulder when the second user's arm is positioned in said arm grip, said upper surface having a length being greater than a length of said lower surface such that said second cushion has a trapezoidal shape.

* * * * *